US006005526A

United States Patent [19]

Jones

[11] Patent Number: 6,005,526

[45] Date of Patent: Dec. 21, 1999

[54] ANTENNA FEEDHORN INCLUDING A HEATER ASSEMBLY

[75] Inventor: Thaddeus M. Jones, Bremen, Ind.

[73] Assignee: MSX, Inc., South Bend, Ind.

[21] Appl. No.: 09/166,027

[22] Filed: Oct. 5, 1998

[51] Int. Cl.[6] ..... H01Q 1/02; H01Q 13/00

[52] U.S. Cl. ..... 343/704; 343/786

[58] Field of Search ..... 343/704, 786, 343/840, 713; H01Q 1/02, 13/00

[56] References Cited

U.S. PATENT DOCUMENTS 2,298,272 10/1942 Barrow ..... 343/786

5,617,107 4/1997 Fleming ..... 343/704

5,844,528 10/1998 Jones ..... 343/786

*Primary Examiner*—Don Wong

*Assistant Examiner*—Tan Ho

*Attorney, Agent, or Firm*—Taylor & Associates, P.C.

[57] ABSTRACT

A heater assembly for use with a feedhorn in an antenna system includes at least two heater bodies, with each heater body being configured to be placed directly against the feedhorn at an exterior periphery of the feedhorn. Each heater body has at least one heater disposed therein, with all of the heaters being electrically connected together. A plurality of springs are connected at opposite ends thereof with adjacent heater bodies. The plurality of springs hold the heater bodies against the feedhorn.

21 Claims, 2 Drawing Sheets

ANTENNA FEEDHORN INCLUDING A HEATER ASSEMBLY

BACKGROUND OF THE INVENTION

1. Field of the Invention

The present invention relates to antenna systems, and, more particularly, to feedhorns for use with antenna systems.

2. Description of the Related Art

A feedhorn or "feed" is a device located at the focus point of a parabolic antenna that acts as a receiver or transmitter of radio wave or microwave frequency energy. Transmitted signals and received signals are at different frequencies to prevent interference. When acting as a receiver, the antenna collects, focuses, and couples the radio wave or microwave energy to the feedhorn, which in turn is coupled with transmission lines and an amplifier. Feedhorns are usually located outdoors, where ice or moisture may collect in the receiving end of the feedhorn, attenuating radio or microwave frequency energy entering or exiting the feedhorn.

It is known to pressurize the inside of a feedhorn with dry air and seal it with a mylar window covering the wide end of the feedhorn. The sealed, dry air prevents the formation of ice or liquid water on the inside of the feedhorn. However, a problem with this method is the difficulty in achieving and maintaining the seal. The seal may leak initially, or it may deteriorate with wear and age. Another problem is that dew, frost or ice may still form on the outside of the mylar window, blocking radio or microwave frequency energy from entering the feedhorn. Yet another problem is that liquid water does not quickly evaporate on a cold surface, so water, in addition to ice, may also collect and attenuate energy which enters or exits the feedhorn.

It is also known to place a heater assembly around the wide end of a feedhorn of an antenna to melt and prevent the formation of ice, snow or water on the feedhorn. For example, U.S. patent application Ser. No. 08/832,527, entitled SATELLITE FEEDHORN INCLUDING HEATER ASSEMBLY, now allowed (U.S. Pat. No. 5,844,528) and assigned to the assignee of the present invention, discloses an elongate element in the form of a cable tie which may be attached to the end of a feedhorn in an antenna system. A heater wire is wrapped around the cable tie and connected with a source of electrical power. The heater assembly effectively reduces or eliminates the accumulation of ice, water or snow on the feedhorn.

The heater assembly as described in U.S. patent application Ser. No. 08/832,527 is a step forward in the art and is particularly useful in conjunction with a feedhorn having a wide end with a substantially circular cross-section. If the wide end of the feedhorn has a differently shaped cross-section, such as a rectangular cross-section, it may be somewhat difficult to form the heater assembly to closely conform to the exterior periphery of the feedhorn, depending upon the radius of curvature between adjacent flat surfaces, etc.

What is needed in the art is a heater assembly to prevent or melt ice accumulation on a feedhorn and on the window covering the end of the feedhorn, regardless of the cross-sectional shape of the wide end of the feedhorn.

SUMMARY OF THE INVENTION

The present invention provides a heater assembly for heating a feedhorn to prevent or melt ice accumulation both inside and outside the window covering the end of the feedhorn.

The invention comprises, in one form thereof, a heater assembly for use with a feedhorn in an antenna system. The heater assembly includes at least two heater bodies, with each heater body being configured to be placed directly against the feedhorn at an exterior periphery of the feedhorn. Each heater body has at least one heater disposed therein, with all of the heaters being electrically connected together. A plurality of springs are connected at opposite ends thereof with adjacent heater bodies. The plurality of springs hold the heater bodies against the feedhorn.

An advantage of the present invention is that ice accumulation is prevented or melted both inside and outside the feedhorn and the window covering the end of the feedhorn.

Another advantage is that the device is operable in and withstands virtually any range of atmospheric pressure.

Yet another advantage is that the device is adjustable to fit different sizes of feedhorns.

A further advantage is that heating of the feedhorn speeds up the evaporation of any water that collects either inside the feedhorn or on the window covering the end of the feedhorn.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
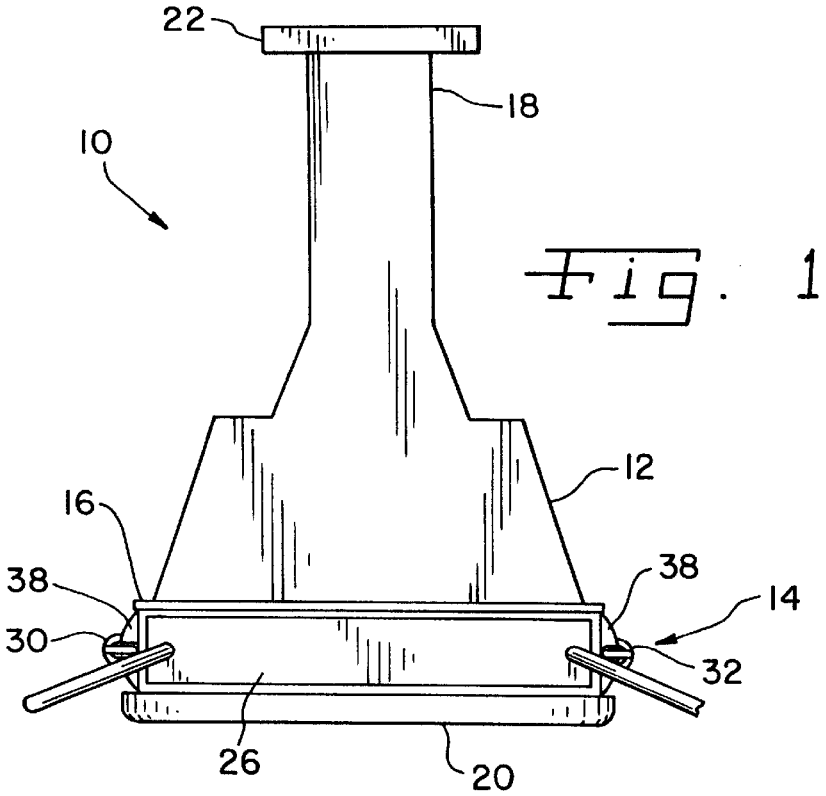
FIG. 1 is a top view of an embodiment of a heater assembly of the present invention attached to an end of a rectangular feedhorn.
Figure 2:
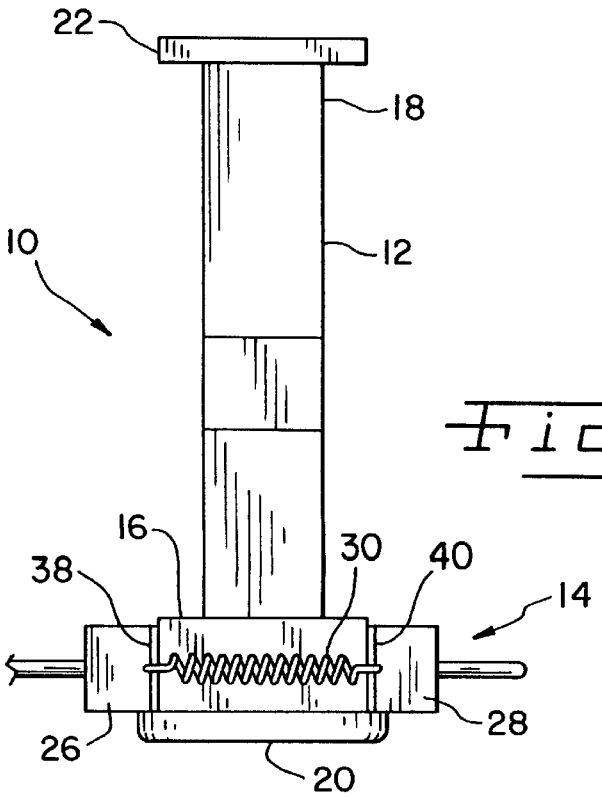
FIG. 2 is a side view of the heater assembly of FIG. 1.

Referring now to the drawings and particularly to FIG. 1, there is shown a heatable feedhorn assembly 10 including a feedhorn 12 and a heater assembly 14.

Figure 3:
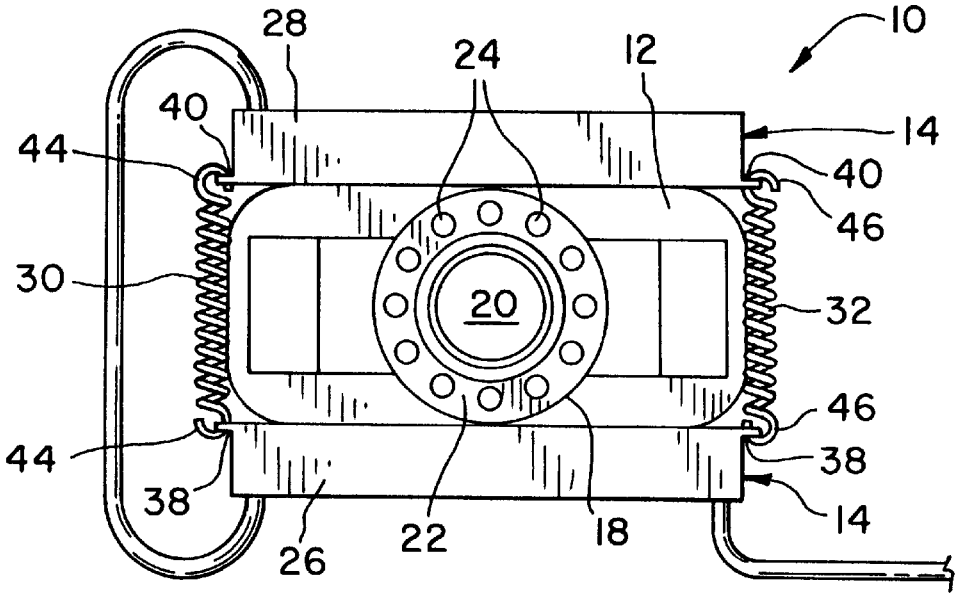
FIG. 3 is a rear view of the heater assembly of FIGS. 1 and 2.

Feedhorn 12 includes a signal receiving and transmitting end or wide end 16 and a more narrow second end 18. A translucent Mylar® window 20 covers wide end 16. Window 20 may be formed from any suitable material allowing the radio frequency waves or microwaves to enter or exit wide end 16 of feedhorn 12. Narrow end 18 includes a flange 22 with a plurality of bolt holes 24 therein. Flange 22 may be bolted to a waveguide (not shown) off an antenna to allow the radio frequency waves or microwaves to be transmitted to or from suitable electrical circuitry (not shown) connected therewith. In the embodiment shown, feedhorn 12 has a substantially rectangular cross-section at wide end 16 (as best seen in FIG. 3). Moreover, feedhorn 12 is fabricated from die cast aluminum in the embodiment shown.

Figure 4:
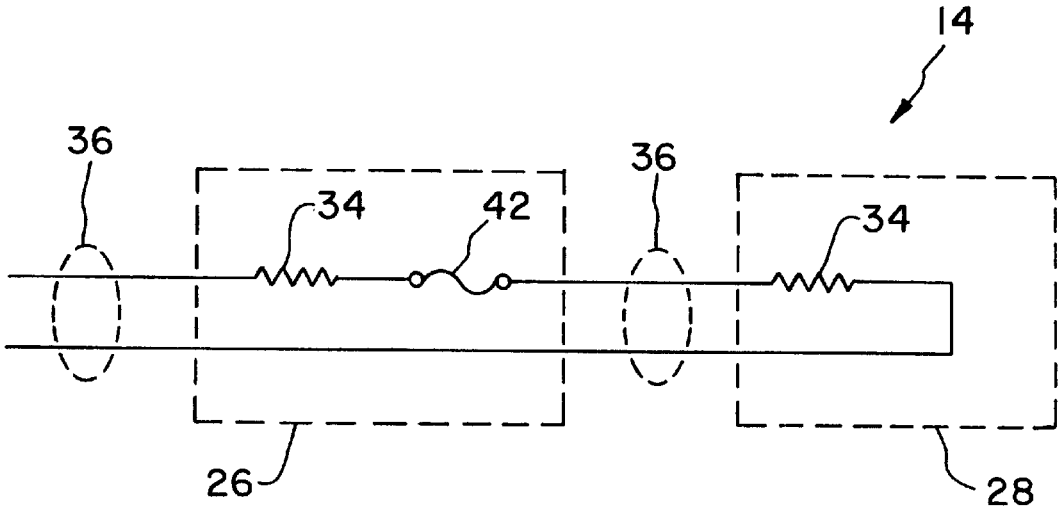
FIG. 4 is an electrical schematic of the heater assembly of FIGS. 1–3.

Heater assembly 14 includes two heater bodies 26 and 28 and two interconnecting springs 30 and 32. Each heater body 26 and 28 is disposed and held against wide end 16 of feedhorn 12, thereby allowing each heater body 26 and 28 to transfer heat directly to wide end 16 of feedhorn 12 during use. Each heater body 26 and 28 has at least one heater 34 (FIG. 4) disposed therein. In the embodiment shown, each heater body 26 and 28 includes a single resistance heater wire 34 therein. Each resistance heater wire 34 may be placed within the corresponding heater body 26 or 28 in any desired manner to effect proper heating of feedhorn 12. For example, each resistance heater wire 34 may be placed in a serpentine or helical pattern within the corresponding heater body 26 or 28 to provide an adequate power density to effect heating of feedhorn 12. Each resistance heater wire 34 is preferably placed within a corresponding heater body 26 or 28 at a location which is substantially close to the side of heater body 26 or 28 which lies against feedhorn 12, thereby improving the heat transfer to feedhorn 12. After being placed within the corresponding heater body 26 or 28, the resistance heater wire 34 may be held in the desired orientation and/or pattern using an epoxy to fill the interior of heater body 26 and 28, such as a thermally conductive and/or electrically insulating epoxy.

Heaters 34 within each heater body 26 and 28 are preferably connected together in series to simplify assembly and installation. For example, a pair of simple two-wire electrical cables 36 connected at each end of heater body 26 and one end of heater body 28 may be used to connect resistance heater wires 34 together in series with a source of electrical power (not shown) attached with two-wire cable 36. However, it is also possible to connect resistance heater wires 34 together other than in series. For example, resistance heater wires 34 may be connected with the source of electrical power in parallel, rather than in series.

Heater bodies 26 and 28 are constructed from any suitable material which is relatively inert to environmental conditions, and preferably is formed from a molded plastic such as polyvinylchloride (PVC) or polycarbonate. However, heater bodies 26 and 28 may be formed from other suitable materials, such as aluminum or stainless steel. A metallic material has the advantage of being more thermally conductive than a plastic material.

Heater bodies 26 and 28 each include a pair of flanges 38 and 40, respectively, at opposite ends thereof. Each flange 38 and 40 includes a hole therein which allows connection with a corresponding spring 30 and 32, as will be described in more detail hereinafter.

Heater body 26 also includes a protection device 42 therein which is connected in series with the resistance heater wire 34 in heater body 26, and interconnected between resistance heater wires 34 located in respective heater bodies 26 and 28. Protection device 42 is configured for protecting resistance heater wires 34 from an over-temperature condition and/or an over-current condition. In the embodiment shown, protection device 42 is in the form of a thermal fuse link; however, another type of protection device such as a thermal cut off (TCO) or slow blow fuse may also be utilized.

Springs 30 and 32 include opposite ends 44 and 46, respectively, which are connected with opposite ends of adjacent heater bodies 26 and 28. More particularly, each of spring ends 44 and 46 defines a hook which passes through a corresponding hole (not numbered) in an associated flange 38 or 40. Springs 30 and 32 are substantially identical to each other, and are preferably compression springs which are slightly extended when heater assembly 14 is placed on wide end 16 of feedhorn 12. Thus, springs 30 and 32 cause heater bodies 26 and 28 to be clamped against wide end 16 of feedhorn 12, thereby holding heater bodies 26 and 28 against wide end 16 of feedhorn 12. Because springs 30 and 32 are configured substantially identically to each other and heater bodies 26 and 28 include a surface which substantially mates with a corresponding surface of feedhorn 12, springs 30 and 32 substantially equidistantly space heater bodies 26 and 28 on opposite sides of the exterior periphery of feedhorn 12. It will be appreciated that if the cross-sectional shape of wide end 16 was a shape other than rectangular (such as circular) and spring 30 and 32 are substantially identical to each other, the heater bodies will still be substantially self-centering on opposite sides of the feedhorn.

In the embodiment shown, heater assembly 14 includes two heater bodies 26 and 28. However, it is to be appreciated that heater assembly 14 may include a different number of heater bodies, depending upon the specific application. For example, if the feedhorn has a wide end with a circular cross-section, a different number of heater bodies, such as three heater bodies, may be provided around the periphery of the wide end. With such a configuration, at least three compression springs would be provided, with each compression spring being placed between and interconnecting an adjacent pair of heater bodies.

Moreover, in the embodiment shown, a single spring interconnects adjacent opposite ends of adjacent heater bodies positioned around the periphery of feedhorn 12. However, it is also to be understood that a different number of springs, such as two or three springs, may interconnect adjacent ends of adjacent heater bodies surrounding feedhorn 12.

In use, current flows through heater wires 36, heating bodies 26 and 28 and, in turn, feedhorn 12. Aluminum, the feedhorn material, is a reasonably efficient conductor of heat. Thus, the temperature of feedhorn 12 remains substantially uniform even though heater wire 30 does not cover all of wide end 14. Feedhorn 12 can be heated enough to inhibit or melt any ice accumulation on either feedhorn 12 or mylar window 16 under any weather conditions to which feedhorn 12 will be exposed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A feedhorn assembly in an antenna system, said feedhorn assembly comprising:

a feedhorn having an end for at least one of receiving and transmitting a signal; and a heater assembly including at least two heater bodies and a plurality of springs, each said heater body disposed against said feedhorn at an exterior periphery of said feedhorn, each said heater body having at least one heater disposed therein, all of said heaters being electrically connected together, each of said plurality of springs having opposite ends and being connected at said opposite ends with adjacent said heater bodies, said plurality of springs holding said at least two heater bodies against said feedhorn.

2. The feedhorn assembly of claim 1, wherein said at least two heater bodies comprises two heater bodies and said plurality of springs comprises two springs, each said spring being connected at said opposite ends with a respective one of said two bodies.

3. The feedhorn assembly of claim 2, wherein said two springs are substantially identical and said bodies are located on substantially opposite sides of said feedhorn.

4. The feedhorn assembly of claim 1, wherein said plurality of springs are substantially identical and conjunctively define a means for equidistantly spacing said bodies around said exterior periphery of said feedhorn.

5. The feedhorn assembly of claim 1, wherein each of said springs comprises a compression spring.

6. The feedhorn assembly of claim 1, wherein said bodies are positioned substantially adjacent to said end of said feedhorn.

7. The feedhorn assembly of claim 1, wherein each said body includes an outwardly projecting flange at opposite ends thereof, and wherein each said spring is connected at said opposite ends thereof with a respective one of said flanges.

8. The feedhorn assembly of claim 7, wherein each said flange includes at least one hole therein, and wherein each said spring includes a hook at each said opposite end thereof which is connected with a respective one of said holes.

9. The feedhorn assembly of claim 1, wherein at least one of said bodies further includes a protection device connected with said at least one heater within said at least one body, said protection device being configured for protecting against at least one of an over-temperature condition and an over-current condition.

10. The feedhorn assembly of claim 9, wherein each said protection device comprises a thermal fuse link.

11. The feedhorn assembly of claim 9, wherein each said body includes one heater therein, and wherein each said protection device is connected in series with said heater in said corresponding body.

12. The feedhorn assembly of claim 1, wherein said heaters are connected in series with each other.

13. The feedhorn assembly of claim 1, wherein each said heater comprises a resistance heater wire.

14. The feedhorn assembly of claim 1, wherein said end of said feedhorn has a substantially rectangular cross section.

15. A heater assembly for use with a feedhorn in an antenna system, comprising:

at least two heater bodies, each said heater body being configured to be placed directly against said feedhorn at an exterior periphery of said feedhorn, each said heater body having at least one heater disposed therein, all of said heaters being electrically connected together; and a plurality of springs, each of said plurality of springs having opposite ends and being connected at said opposite ends with adjacent said heater bodies, said plurality of springs defining a means for holding said at least two heater bodies against said feedhorn.

16. The heater assembly of claim 15, wherein said at least two heater bodies comprises two heater bodies and said plurality of springs comprises two springs, each said spring being connected at said opposite ends with a respective one of said two bodies.

17. The heater assembly of claim 16, wherein said two springs are substantially identical and said bodies are located on substantially opposite sides of said feedhorn.

18. The heater assembly of claim 15, wherein said plurality of springs are substantially identical and conjunctively define a means for equidistantly spacing said bodies around said exterior periphery of said feedhorn.

19. The heater assembly of claim 15, wherein each said body includes an outwardly projecting flange at opposite ends thereof, and wherein each said spring is connected at said opposite ends thereof with a respective one of said flanges.

20. The feedhorn assembly of claim 15, wherein at least one of said bodies further includes a protection device connected with said at least one heater within said at least one body, said protection device being configured for protecting against at least one of an over-temperature condition and an over-current condition.

21. The feedhorn assembly of claim 20, wherein each said protection device comprises a thermal fuse link.

* * * * *